US009765629B2

(12) United States Patent
Justl et al.

(10) Patent No.: US 9,765,629 B2
(45) Date of Patent: Sep. 19, 2017

(54) METHOD AND COOLING SYSTEM FOR COOLING BLADES OF AT LEAST ONE BLADE ROW IN A ROTARY FLOW MACHINE

(71) Applicant: ALSTOM Technology Ltd, Baden (CH)

(72) Inventors: Sascha Justl, Zürich (CH); Carlos Simon-Delgado, Baden (CH); Axel Heidecke, Wettingen (CH); Sven Olmes, Windisch (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 1036 days.

(21) Appl. No.: 14/031,660

(22) Filed: Sep. 19, 2013

(65) Prior Publication Data

US 2014/0086743 A1 Mar. 27, 2014

(30) Foreign Application Priority Data

Sep. 26, 2012 (EP) ..... 12186156

(51) Int. Cl.
*F01D 5/08* (2006.01)
*F01D 5/18* (2006.01)
(Continued)

(52) U.S. Cl.
CPC ..... *F01D 5/186* (2013.01); *F01D 5/08* (2013.01); *F01D 5/187* (2013.01); *F01D 5/225* (2013.01); *F01D 11/10* (2013.01)

(58) Field of Classification Search
CPC . F01D 5/08; F01D 5/187; F01D 5/225; F01D 5/186; F01D 11/10
See application file for complete search history.

(56) References Cited

U.S. PATENT DOCUMENTS 2,963,268 A 12/1960 Smile et al.
3,703,808 A * 11/1972 Stearns ..... F01D 5/18 415/115
(Continued)

FOREIGN PATENT DOCUMENTS

EP 1 591 626 11/2005
EP 2 390 466 11/2011
(Continued)

OTHER PUBLICATIONS

Office Action (Notification on Results of Patentability Check) issued on Jun. 17, 2015, by the Russian Patent Office in corresponding Russian Patent Application No. 2013143443/06 (066874), and an English Translation of the Office Action. (9 pages).

*Primary Examiner* — Igor Kershteyn
(74) *Attorney, Agent, or Firm* — Buchanan Ingersoll & Rooney PC

(57) ABSTRACT

A method and a cooling system for cooling blades of at least one blade row in a rotary flow machine includes an axial flow channel which is radially limited on the inside by a rotor unit and at the outside by at least one stationary component, the blades are arranged at the rotary unit and provide a shrouded blade tip facing radially to said stationary component. Pressurized cooling air is fed through from radially outside towards the tip of each of said blades in the at least one blade row, and the pressurized cooling air enters the blades through at least one opening at the shrouded blades' tip.

12 Claims, 1 Drawing Sheet

(51) Int. Cl.
*F01D 5/22* (2006.01)
*F01D 11/10* (2006.01)

(56) References Cited

U.S. PATENT DOCUMENTS 4,157,880 A * 6/1979 Klompas ..... F01D 5/185 415/115
4,161,318 A * 7/1979 Stuart ..... B23P 6/002 277/431
4,178,129 A 12/1979 Jenkinson
4,390,320 A * 6/1983 Eiswerth ..... F01D 5/005 29/889.1
4,534,701 A * 8/1985 Wisser ..... F01D 11/08 415/168.4
4,540,335 A * 9/1985 Yamaguchi ..... F01D 7/00 415/129
4,580,943 A 4/1986 Scully
5,224,713 A * 7/1993 Pope ..... F01D 11/02 277/415
5,232,338 A * 8/1993 Vincent de Paul ..... F01D 5/145 415/115
5,984,636 A 11/1999 Fähndrich et al.
6,632,069 B1 * 10/2003 Naljotov ..... F01D 5/225 415/173.5
8,202,039 B2 * 6/2012 Guemmer ..... F01D 5/225 415/148

FOREIGN PATENT DOCUMENTS

FR 1193436 A 11/1959
JP 10-317905 12/1998
JP 11-159303 6/1999
JP 2012-117537 6/2012
JP 2013-249835 12/2013
RU 2179245 2/2002

* cited by examiner

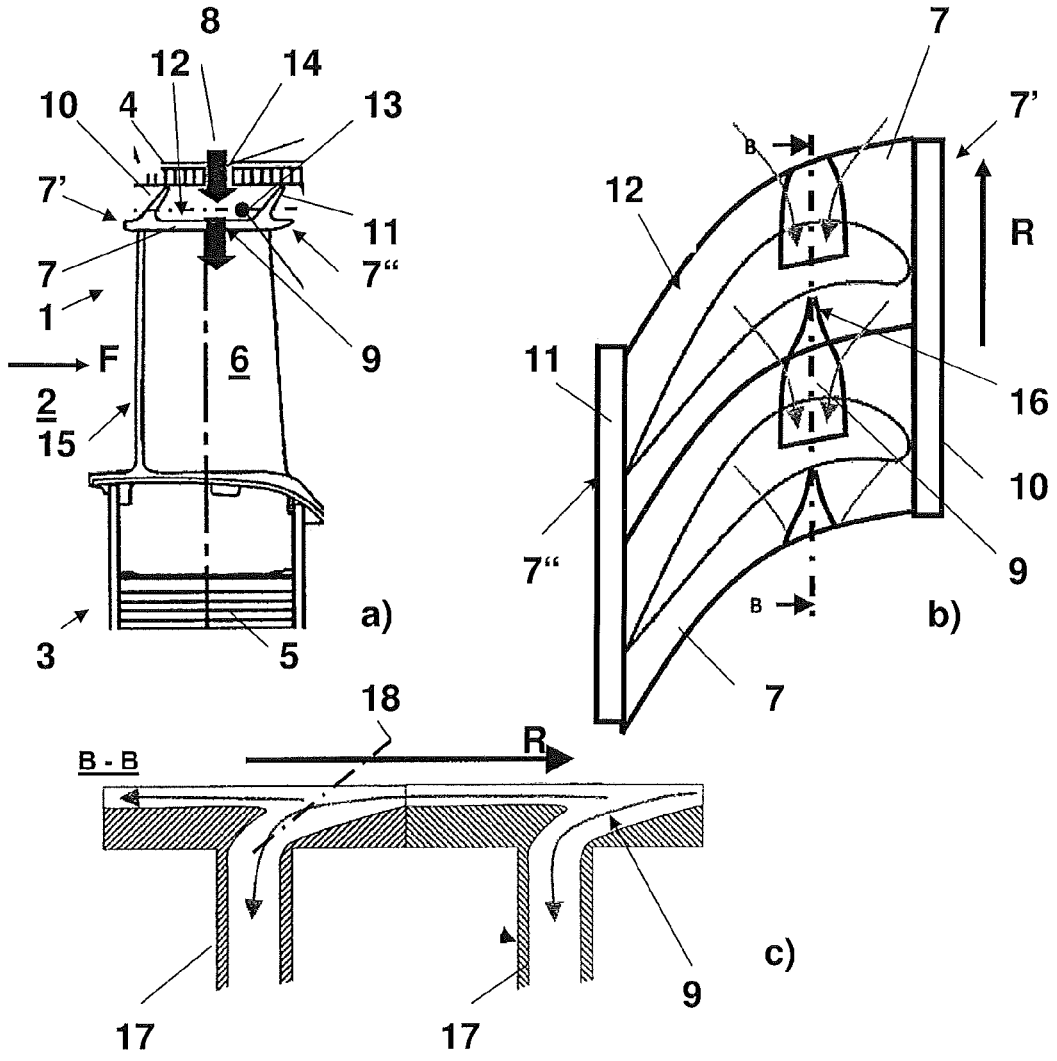
8
12
14
10
4
13
7'
11
7
7"
1
F
6
9
2
15
3
5
a)
7
7'
12
R
11
16
10
7"
9
B
B
b)
7
18
R
B - B
c)
9
17
17

METHOD AND COOLING SYSTEM FOR COOLING BLADES OF AT LEAST ONE BLADE ROW IN A ROTARY FLOW MACHINE

CROSS-REFERENCE TO RELATED APPLICATIONS

This application claims priority to European application 12186156.1 filed Sep. 26, 2012, the contents of which are hereby incorporated in its entirety.

TECHNICAL FIELD

The present invention relates to a method as well to a cooling system for cooling blades of at least one blade row in a rotary flow machine, like a gas or steam turbo machine or a compressor unit, comprising an axial flow channel, which is radially limited on the inside by a rotor unit and at the outside by at least one stationary component, said blades are arranged at the rotary unit and provide a shrouded blade tip facing radially to said stationary component.

BACKGROUND

It is a common used technique for increasing engine efficiency and performance to cool heat exposed components of rotary flow machines. Especially cooling of turbine blades in gas or steam turbo engines is of high importance to operate such turbines at higher temperatures than would be permissible with uncooled turbine blades.

A well known cooling technique for the rotating blades in a rotary flow machine is based on feeding the blades via the rotating unit providing internal cooling channels which are indirectly or directly fluidly connected with a cooling channel system inside the blades.

U.S. Pat. No. 4,178,129 discloses a gas turbine engine cooling system in which each blade roots is provided with individual pitot receivers which collect a portion of a cooling flow supplied from an annular array of pre-swirl nozzles, which have a circumferentially continuous outlet flow area and direct said cooling flow into a portion only of the interior of the blade, preferably adjacent the leading edge.

Another cooling arrangement for a bladed rotary in a gas turbine engine is disclosed in U.S. Pat. No. 5,984,636. Each of the blades includes cooling air passages and a cover with curved fins mounted adjacent to but connected to the rotor and spaced apart slightly from the rotor disc to form a passage way for the cooling fluid. The cavity which is bordered by the cover and the rotor disc is fed on a relative low radius and the pressure rise is achieved with vanes working like a radial compressor. Complicated design making a separate part attached to the rotor necessary.

A multitude of further solutions are well known for feeding blades with cooling air via rotor bores, these solutions however might cause life time problems because if there is not enough space for feeding cooling air into the rotating blades pressure will rise and might not be sufficient finally.

SUMMARY

It is a general object of the present invention to provide a method as well a cooling system for cooling blades of at least one blade row in a rotary flow machine which simplifies feeding of cooling air into the rotating blades of the rotary flow machine.

The object is achieved by the method given in claim 1. An inventive cooling system is disclosed in claim 4. Finally an inventive rotary flow machine is content of claim 12. The invention can be modified advantageously by the features disclosed in the sub claims as well in the following description especially referring to the preferred embodiment.

The invention is used for providing cooling air for an internal cooled rotating turbine blade and is based on the idea to feed the internal blade cooling system via the tip of each blade within at least one blade row of the rotary flow machine. Therefore, the inventive method for cooling blades of at least one blade row in a rotary flow machine, comprising an axial flow channel which is radially limited on the inside by rotor unit and at the outside by at least one stationary component, said blades are arranged at the rotary unit and provide a shrouded blade tip facing radially to said stationary component, is characterized in that said pressurized cooling air is fed through from radially outside towards the tip of each of said blades in the at least one blade row, and said pressurized cooling air enters the blades through at least one opening at the shrouded blades' tip.

An important aspect for realizing feeding the internal blade cooling system via the tip of each blade is to ensure that no hot gas can enter the internal blade cooling system via openings at the shrouded blades' tip. To comply with this requirement it is necessary to ensure that the immediate area around the at least one opening at the shrouded blades tip is supplied with cooling air at a preferably low temperature and a static pressure with is higher than the total relative pressure of the hot gas inside the axial flow channel especially at the blade leading edge.

In a preferred embodiment the pressurized cooling air is fed through the stationary components surrounding said at least one blade row radially and entering a cavity enclosed by the stationary component and shrouded tips of the blades in the at least one blade row. The shroud of each blade provides at its upstream and downstream edge relative to the flow direction through the axial flow channel of the rotary flow machine at least one fin which arise radially beyond a shroud surface extending between the at least two fins. Such shrouded tips of the blades are designed and arranged in a manner that shrouds of two neighboring blades adjoin each other in a circumferential direction, so that the shrouds of all blades in the at least one blade row combine to form a radially outward directed annular shaped inter fin cavity bordered radially by the stationary component. It is possible also to provide more than two fins at a shroud for forming more than one inter fin cavity the following explanations are directed to shrouded blades having one inter fin cavity without limiting the scope of the invention. The inter fin cavity which is enclosed by all shrouded blades within one blade row has the shape of an annulus which is fed by at least one opening in the stationary component with cooling air so that a static pressure prevails inside the inter fin cavity which is at least slightly higher than the pressure in the axial flow channel of the rotary flow machine.

Since the blades rotate around an axis of rotation of the rotary flow machine the cooling air inside the annulus is entrained in direction of rotation. To enhance the inflow of cooling air into the opening at the shroud of each blade the entrance opening has a special opening contour through which the flow of cooling air in the annulus is decelerated locally relative to the shrouds. This can be achieved by shaping the opening of each shroud like a funnel having a funnel shaped cross-section with an assigned funnel axis tending into circumferential direction of rotation. In addition the opening contour provides an extension in axial, radial and circumferential direction such that a flow cross-section of said aperture becomes larger in flow direction of the cooling air when entering the aperture.

The inventive cooling system for cooling blades of at least one blade row in a rotary flow machine provides therefore at least one opening at the stationary component facing radially towards the shrouded tips of the blades of the at least one blade row. Further the at least one opening is an exit aperture of a cooling channel inside the stationary component. In a preferred embodiment the cooling air will be provided by a compressor unit which is typical part of a gas or steam turbine arrangement. Further each of the blades provides at least one aperture at its shrouded blade tip whereby the aperture is an entrance port of a cooling channel inside the blade.

BRIEF DESCRIPTION OF THE FIGURES

The invention shall subsequently be explained in more detail based on exemplary embodiment in conjunction with the drawing. The drawing FIG. 1*a* shows a side view of a blade inside a rotary flow machine, FIG. 1*b* shows a schematically top view of two shrouded blade tips within one blade row and FIG. 1*c* shows a sectional view along cut line BB through the head part of to neighboring shrouded blades in circumferential direction of a blade row.

DETAILED DESCRIPTION

FIG. 1 shows a side view of a blade 1 mounted in a blade row of a rotary flow machine. The rotary flow machine comprises a flow channel 2 which is radially limited on the inside by rotor unit 3 and the outside by at least one stationary component 4. Typically the stationary component 4 is a heat shield component which is mounted at the inner wall of a casing surrounding said rotary flow machine. Each blade 1 of the blade row comprises a shovel foot 5 which is detachably connected to the rotor unit 3, an air foil 6 extending radially through the axial flow channel 2 and being exposed to the hot gas flow passing the axial flow channel, and finally a shroud 7 at the blade tip's end.

For cooling purpose of the blade 1 it is inventively suggested to feed cooling air 8 radially outward from the stationary component into the blade 1 through an opening 9 at the shrouded blade tip. By radial cooling air supply to the blade 1 from radially outside through at least one stationary component 4 complex designed cooling channels inside the rotor unit, as described above, can be avoided. The cooling air supply to the stationary component 4 can be designed and arranged very easy so that constructive and financial expense for realizing cooling of the blades 1 can be reduced significantly.

To ensure that no hot gases will enter the opening 9 of the cooling channel inside the blade 1 the shroud 7 provides an upstream edge 7' and a downstream edge 7" relative to the axial flow direction through the axial flow channel 2 illustrate by the arrow F in FIG. 1*a* which is directed from the left to the right. Along the upstream edge 7' a first fin 10 and along the downstream edge 7" a second fin 11 are arranged, both fins 10, 11 arise radially beyond the shroud surface 12 extending between both of fins 10, 11. Due to the shroud design and the arrangement of the blade 1 relative to the stationary component 4 the shroud 7 encloses an inter fin cavity 13 together with the stationary component 4 into which cooling air 8 is fed through the opening 14 of the stationary component which is an exit port of a cooling channel system inside the stationary component not shown. The pressurized cooling air 8 is fed into the inter fin cavity 13 such that a static pressure previous within said cavity 13 is higher than a total relative pressure of flow in the axial flow channel 2 at a leading edge 15 of the blade 1 in the at least one blade row. In this way it can be avoided that hot gases can enter the inter fin cavity 13.

The at least one opening 14 inside the stationary component 4 is arranged in radially projection to the shrouded blade tips and the number of such openings 14 depends on the desired cooling effect in the blades. If the cooling air supply cannot be met by just one opening more openings can be arranged in circumferential direction around the blade row inside the stationary component.

FIG. 1*b* shows a schematically top view on two neighboring shrouded blade tips with an indicated profile of the airfoil of each blade. Each shroud 7 provides an upstream edge 7' along which fin 10 and an downstream edge 7" along which fin 11 are arranged each extending beyond the shroud surface 12 extending axially between both fins 10, 11. In FIG. 1*b* it is assumed that the fins 10, 11 arise beyond the drawing plain.

Further it is shown that the shrouds 7 of two neighboring blades adjoin each other in the circumferential direction R which corresponds to the movement of rotation of the rotary flow machine, so that the shrouds 7 of all blades in the at least one blade row combine to form a radially outwardly directed annular shaped inter fin cavity 13 which is seen in FIG. 1*b* from the top view.

Each blade provides at its shroud 7 at least one opening 9 at the shroud surface 12 which is an entrance port of a cooling channel 17 inside the blade 1. See also FIG. 1*c* which shows a sectional view along a cut line BB as indicated in FIG. 1*b*. Each opening 9 has an overlap to at least one neighboring shroud and provides an opening contour having an extension in axial and in circumferential direction such that in radial protection onto the shroud 7 as illustrated in FIG. 1*b*, the aperture 9 corresponds to a bottle neck shape with a smallest axial width 16 directed in circumferential direction of rotation R. Such shape of aperture sustains an inflow of cooling medium into the cooling channel 17 of the blade 1. Especially the cross section design of each aperture 9 which is illustrated in FIG. 1*c* supports an inflow of cooling air into the cooling channel 17, due to a funnel shaped cross section in radially and circumferentially direction of the opening contour of the opening 9 which has a funnel axis 18 tending into circumferential direction R of rotation.

As indicated in FIG. 1*a* the top of each fin 10, 11 is arranged very close to the inner surface of the stationary part 4 which is, as explained before a heat shield component preferably, so that a leakage of cooling air escaping from the inter fin cavity 13 into the flow path 2 can be reduced significantly. In preferred embodiment the fins 10, 11 and the heat shield component are arranged and designed to realize a labyrinth sealing.

The invention claimed is:

1. A method for cooling blades of at least one blade row in a rotary flow machine, comprising an axial flow channel which is radially limited on the inside by a rotor unit and at the outside by at least one stationary component, said blades are arranged at the rotary unit and provide a shrouded blade tip facing radially to said stationary component, wherein the pressurized cooling air is fed through from radially outside towards the tip of each of said blades in the at least one blade row, and said pressurized cooling air enters the blades through at least one opening at the shrouded blade tip.

2. The method according to claim 1, wherein the pressurized cooling air is fed through the stationary component surrounding said at least one blade row radially and entering a cavity enclosed by the stationary component and shrouded tips of the blades in the at least one blade row.

3. The method according to claim 2, wherein the pressurized cooling air is fed into the cavity through at least one stationary component sided opening such that a static pressure prevails within said cavity which is higher than a total relative pressure of a flow in the axial flow channel at a leading edge of the blades in the at least one blade row.

4. A cooling system for cooling blades of at least one blade row in a rotary flow machine comprising an axial flow channel which is radially limited on the inside by a rotor unit and at the outside by at least one stationary component, said blades are arranged at the rotary unit and provide a shrouded blade tip facing radially to said stationary component, wherein at least one opening is arranged at the stationary component facing radially towards the shrouded tips of the blades of the at least one blade row, said at least one opening is an exit port of a cooling channel inside the stationary component, each of the blades provides at least one aperture at its shrouded blade tip, and said aperture is an entrance port of a cooling channel inside the blade.

5. The cooling system according to claim 4, wherein the shrouded tips of the blades are designed and arranged such that the shroud of each blade provides an upstream and a downstream edge relative to an axial flow direction through said axial flow channel of the rotary flow machine, and along said up- and downstream edge at least one fin is arranged arising radially beyond a shroud surface extending between both fins.

6. The cooling system according to claim 5, wherein the shrouded tips of the blades are designed and arranged such that shrouds of two neighbouring blades adjoin each other in a circumferential direction, so that the shrouds of all blades in the at least one blade row combine to form at least one a radially outwardly directed annular shaped inter fin cavity bordered radially by the stationary component.

7. The cooling system according to claim 5, wherein the opening contour of the aperture provides a funnel shaped cross-section in radially and circumferentially direction, said funnel shaped cross-section has an assigned funnel axis tending into circumferential direction of rotation.

8. The cooling system according to claim 7, wherein each aperture of the shrouded blade tip provides an opening contour having an extension in axial, radial and circumferential direction such that a flow cross-section of said aperture becomes larger in flow direction of the cooling air entering the aperture.

9. The cooling system according to claim 7, wherein the opening contour of each aperture extends between two or more neighbouring blades.

10. The cooling system according to claim 4, wherein the exit port of the at least one opening has an assigned axis which is orientated radially.

11. The cooling system according to claim 4, wherein the rotary flow machine is a gas or steam turbo machine or a compressor unit.

12. A rotary flow machine comprising an axial flow channel which is radially limited on the inside by a rotor unit and at the outside by at least one stationary component, and blades within at least one blade row being arranged at the rotary unit and provide a shrouded blade tip facing radially to said stationary component, characterized in that at least one opening is arranged at the stationary component facing radially towards the shrouded tips of the blades of at least one blade row, said at least one opening is an exit port of a cooling channel inside the stationary component, each of the blades provides at least one aperture at its shrouded blade tip, and said aperture is an entrance port of a cooling channel extending within the blade.

* * * * *